US008590077B2

(12) United States Patent
Saunders et al.

(10) Patent No.: US 8,590,077 B2
(45) Date of Patent: Nov. 26, 2013

(54) HANDS-FREE EMERGENCY ALL-TERRAIN LIGHT-WEIGHT LITTER

(76) Inventors: Ryan Warwick Saunders, San Diego, CA (US); Pamela Kelley Saunders, San Diego, CA (US); Cindy Richardson Saunders, Ridgway, CO (US)

( * ) Notice: Subject to any disclaimer, the term of this patent is extended or adjusted under 35 U.S.C. 154(b) by 347 days.

(21) Appl. No.: 13/008,795

(22) Filed: Jan. 18, 2011

(65) Prior Publication Data

US 2011/0220695 A1 Sep. 15, 2011

Related U.S. Application Data

(60) Provisional application No. 61/336,185, filed on Jan. 19, 2010.

(51) Int. Cl.
*A61G 7/10* (2006.01)

(52) U.S. Cl.
USPC ..... 5/628; 5/625

(58) Field of Classification Search
USPC ..... 5/625–628, 81.1 T
See application file for complete search history.

(56) References Cited

U.S. PATENT DOCUMENTS

| | | | | |
|---|---|---|---|---|
| 1,231,989 | A | 7/1917 | Blatt | |
| 2,285,238 | A | 6/1942 | Thomson | |
| 2,480,322 | A | 8/1949 | Cozzoli | |
| 3,247,529 | A | 4/1966 | Benton | |
| 3,417,412 | A | 12/1968 | Andrews | |
| 4,178,032 | A | 12/1979 | Hone | |
| 4,397,432 | A | 8/1983 | Resetar | |
| 6,698,811 | B1 | 3/2004 | Schuchman | |
| 7,168,110 | B2 * | 1/2007 | Girard et al. | 5/89.1 |
| 7,707,666 | B2 | 5/2010 | Calkin et al. | |
| 8,336,141 | B2 * | 12/2012 | Wong | 5/627 |
| 2010/0005593 | A1 | 1/2010 | Bowling et al. | |

OTHER PUBLICATIONS

Soft Litter Individual Carry Kit (SLICK)—External Frame Backpack—www.arucsystems.com.

* cited by examiner

*Primary Examiner* — Fredrick Conley
(74) *Attorney, Agent, or Firm* — Gordon & Rees LLP

(57) ABSTRACT

A hands-free emergency all terrain light-weight litter, having: a panel having a leg support portion, a body support portion and a head support portion; a pair of parallel longitudinal support straps running along the length of the panel, and extending from opposite ends of the panel; and a plurality of interlocking patient stabilization straps extending from the body support portion of the panel, wherein the interlocking patient stabilization straps are dimensioned to pass over a patient's upper body, and lock together over the front of the patient's upper body.

19 Claims, 20 Drawing Sheets

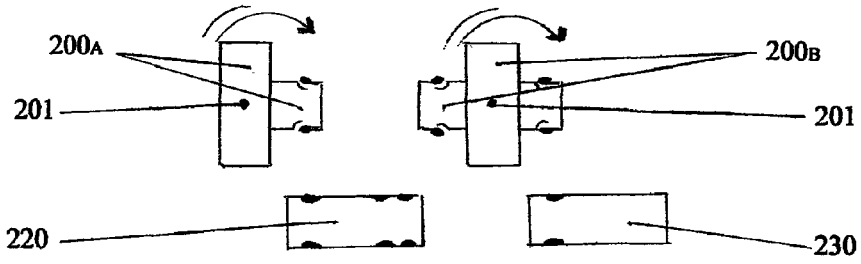
Figure 28A
Figure 28B
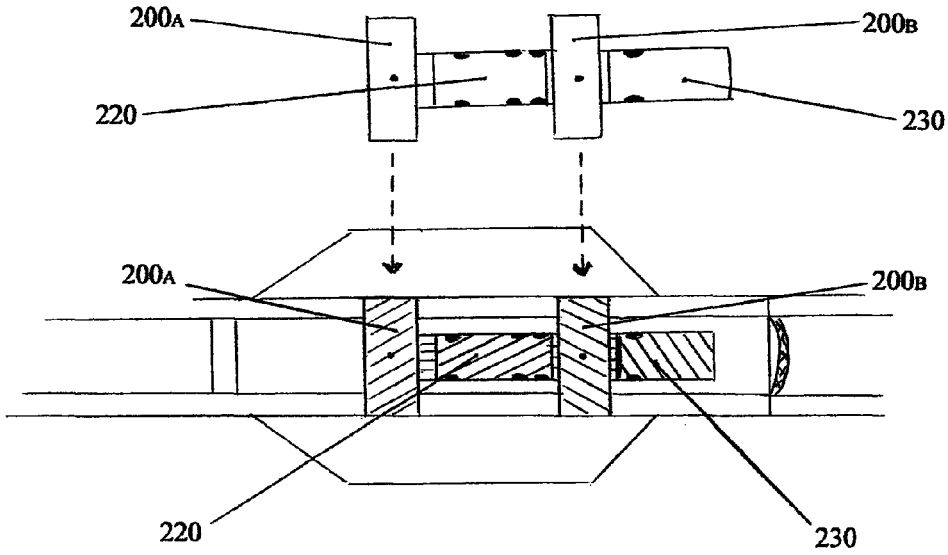
Figure 28C

HANDS-FREE EMERGENCY ALL-TERRAIN LIGHT-WEIGHT LITTER

RELATED APPLICATION

The present application claims priority to U.S. Provisional Patent Application Ser. No. 61/336,185; filed Jan. 19, 2010, and entitled "HEALL", the full disclosure of which is incorporated herein by reference in its entirety.

BACKGROUND OF THE INVENTION

Standard patient transport litters are large and bulky. They typically have a large, heavy pole running down the sides of the litter, and they require two people to operate (i.e.: a person standing at the front and back ends holding onto two poles). Moreover, these lifters first need to be unfolded, and then the poles locked into position prior to use. As a result, these litters are not well suited to being carried by troops during tactical patrols. In addition, carrying the litter requires both hands of the rescuers.

What is instead desired is a small portable litter that can be easily carried and operated by a single person (or several people) over a variety of terrain. It is also desired that the litter can be operated while keeping the hands of the rescuer(s) free to carry equipment, or to attend to the patient. The present invention provides such a litter.

SUMMARY OF THE INVENTION

The present invention provides a compact, lightweight patient transport litter that can be made of canvas (or other material), seat belt strapping, metal or plastic lock buckles and metal hooks and rings. By getting rid of traditional poles, both the size and weight of the present litter is substantially reduced and it is able to be carried (and even operated) by a single person, such as a soldier in battle.

In preferred embodiments, the present invention provides a light-weight emergency litter for evacuating or transporting a patient, comprising: a panel having a leg support portion, a body support portion and a head support portion; a pair of parallel longitudinal support straps running along the length of the panel, and extending from opposite ends of the panel; and a plurality of interlocking patient stabilization straps extending from the body support portion of the panel, wherein the interlocking patient stabilization straps are dimensioned to pass over a patient's upper body, and lock together over the front of the patient's upper body. Preferably, the panel is a fabric panel such as canvas. However, any suitable flexible light-weight material may be used, including but not limited to Kevlar® and mesh fabrics. In one optional embodiment, the panel is not included, and the present invention merely consists of straps supporting the patient.

In preferred embodiments, the present litter includes an upper lateral strap passing across the panel in an area adjacent to a patient's neck and shoulders; a mid-lateral strap passing across the panel in an area adjacent to the patient's hips; and a shin strap dimensioned to wrap around a patient's shins.

Also in preferred embodiments, the plurality of interlocking patient stabilization straps may comprise: a pair of hip-to-shoulder straps that cross diagonally across the top side of the panel between the pair of parallel longitudinal support straps such that the straps form a cross on the body support portion of the panel under a patient's upper body. In addition, the ends of the pair of hip-to-shoulder straps may be connected to the ends of the mid-lateral strap. Also preferably included is a hip strap connected to the bottom of the panel to wrap upwardly around the patient, and lock together over a patient's hips. Finally, a center strap may be included and is preferably connected to the hip strap. This center strap runs parallel to the pair of longitudinal support straps over the center of a patient's upper body. The pair of hip-to-shoulder straps preferably each have a connecting ring, and the center strap may have a carabiner thereon. As will be shown, the carabiner attaches to the connecting rings on the hip-to-shoulder straps such that the patient is fastened securely and comfortably onto the litter.

The present invention has numerous advantages, including but not limited to, the following:

First, traditional litters required two poles supporting opposite sides of the litter. A patient support panel spanned between these two side poles. With these traditional systems, two people are required to transport a patient. Specifically, a person standing in front of the litter grabs the two front ends of the poles and a person standing behind the litter grabs the two back ends of the poles to lift the patient. Both hands of both rescuers are occupied when carrying such a litter. In addition to requiring two people to operate, these traditional litters are large, bulky and heavy. Needless to say, they do not function well in combat situations, as they are difficult to carry into, and out of, the battlefield.

In contrast, the present litter preferably has no poles. Instead, it simply consists of a canvas panel, having a number of belts and fasteners extending therefrom. Thus, it is lightweight, and it can be folded up and easily carried by a single individual. In fact, it can be folded up to such a small size that it can be fit into a small backpack. In addition, the present litter can be operated such that the rescuer(s)'s hands remain free to carry equipment or tend to the patient.

Second, the present litter can be operated by a single person. A lone rescuer can use the litter to pull a wounded person out of a danger area. However, the present litter can also be conveniently used by two, three or even four rescuers. Moreover, it is possible to quickly and easily change between the number of rescuers used (for example, when negotiating difficult terrain or situations). As will be shown, there are a number of different carrying positions and support belt configurations that can be used when carrying the litter. As a result, the present litter can be used to quickly, efficiently and effectively transport or evacuate wounded persons from all situations and from all types of terrain.

Third, the present litter can optionally be used in conjunction with a secondary litter if desired. For example, the patient can be carried with the present litter and then placed directly onto a second (e.g.: a larger, poled) litter. Once the final destination is reached (e.g.: a medical treatment facility or hospital), the present litter can be cut away from the patient using standard trauma shears or simply unbuckled.

Fourth, the present litter can be carried by one or more rescuers while still keeping the hands of the rescuers free to carry or move other objects, or to attend to the patient.

BRIEF DESCRIPTION OF THE DRAWINGS

FIGS. 28A to 28C illustrate an embodiment of the invention having a folding framework for torso and head support.

DETAILED DESCRIPTION OF THE DRAWINGS

Figure 1:
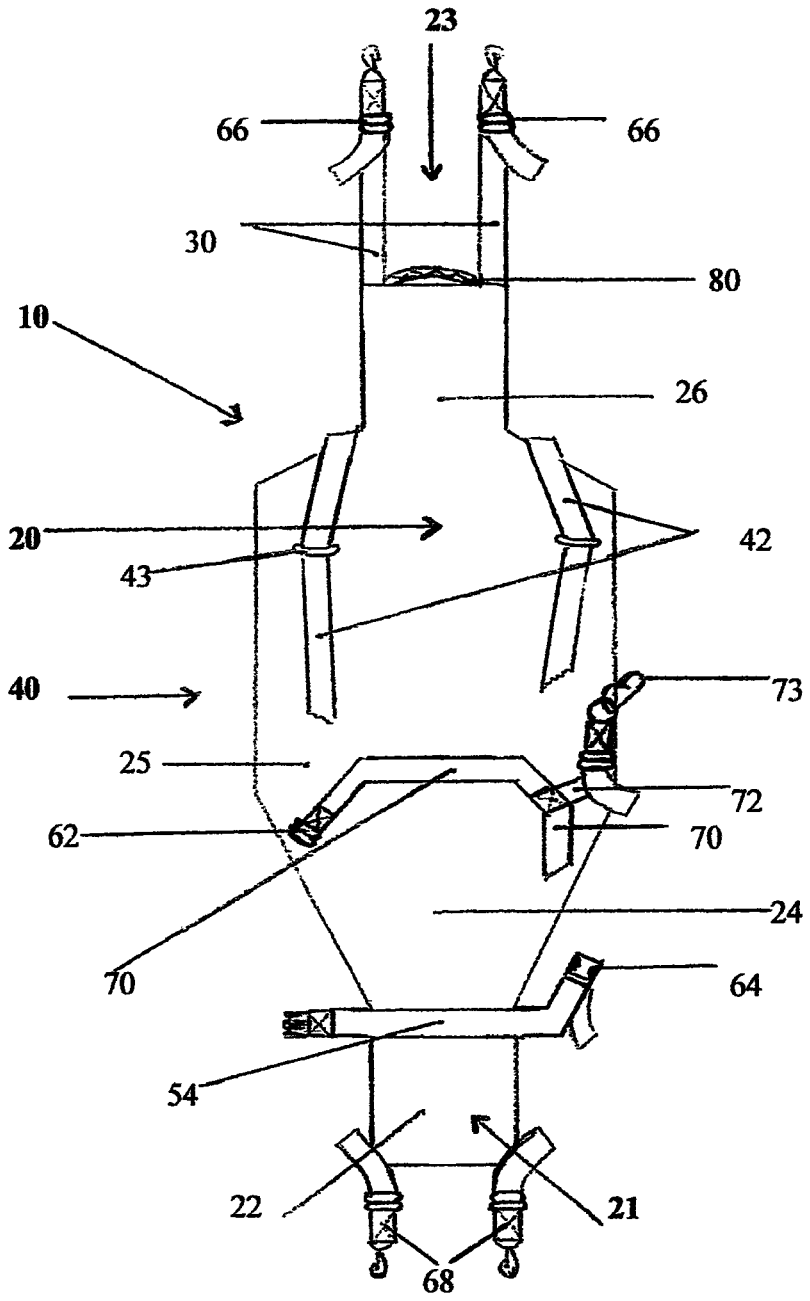
FIG. 1 is a top plan view of the present invention.
Figure 2:
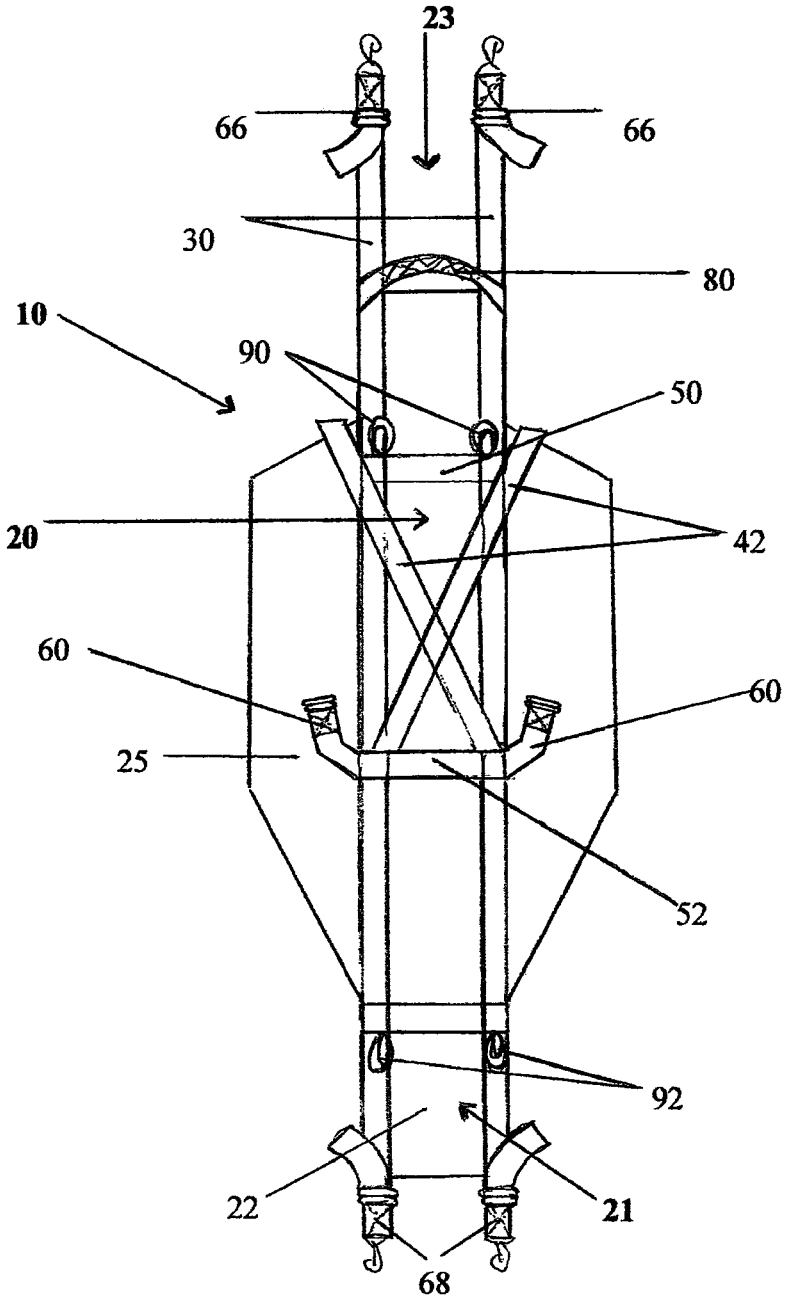
FIG. 2 is a bottom plan view of the present invention.
Figure 3:
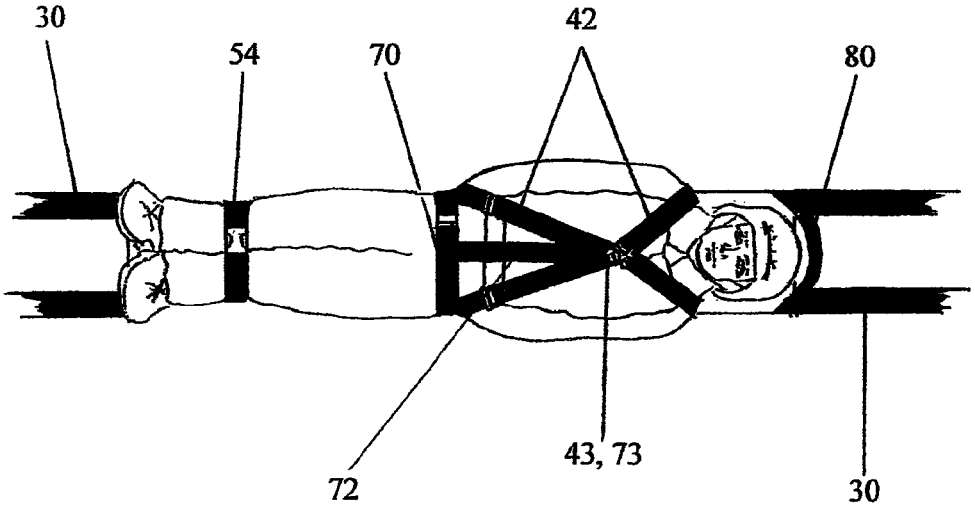
FIG. 3 is a top plan view of the present invention as configured to transport a patient.
Figure 4:
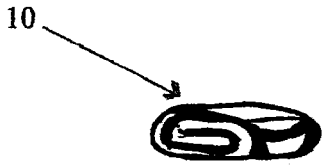
FIG. 4 is a perspective view of the present invention wrapped up and ready for storage.

Referring first to FIGS. 1 and 2, the present invention provides a litter 10, comprising: a panel 20 having a leg support portion 22, a body support portion 24 and a head support portion 26; a pair of parallel longitudinal support straps 30 running along the length of the panel and extending from opposite ends 21 and 23 of panel 20; and a plurality of interlocking patient stabilization straps 40 extending from the body support portion 24 of panel 20, wherein the interlocking patient stabilization straps 40 are dimensioned to pass over a patient's upper body, and lock together over the front of the patient's upper body (as shown in FIG. 3).

In preferred embodiments, panel 20 is a fabric panel. Panel 20 can optionally be made from canvas, Kevlar®, or any other suitable material including mesh fabrics with or without rubberized coatings. As will be explained, the pair of parallel longitudinal support straps 30 may be sewn directly onto the leg 22, body 24 and head 26 support portions of canvas panel 20.

Also included is an upper lateral strap 50 connected to longitudinal support straps 30, wherein the upper lateral strap 50 extends perpendicularly between the pair of longitudinal support straps 30 across the panel in an area adjacent to a patient's neck and shoulders as shown. Upper lateral strap 50 assists in bearing the weight of the patient.

Also included is a mid-lateral strap 52 connected to longitudinal support straps 30, wherein the mid-lateral strap 52 extends perpendicularly between the pair of longitudinal support straps 30 across panel 20 in an area adjacent to the patient's hips as shown. Mid-lateral strap 52 also assists in bearing the weight of the patient.

Also included is a shin strap 54 connected to panel 20, shin strap 54 extending perpendicular to the pair of longitudinal support straps 30. Shin strap 54 is dimensioned to wrap around the patient's shins, and lock together (using buckle 64) over the front of the patient's shins. Shin strap 54 keeps the patient's legs secured to leg support portion 22 of the litter.

As can be seen in FIG. 1, the plurality of interlocking patient stabilization straps 40 preferably cross diagonally over a patient's hips and shoulders, and are locked together over a patient's chest. In preferred embodiments, the plurality of interlocking patient stabilization straps 40 may comprise a pair of hip-to-shoulder straps 42 crossing diagonally across the top side of the panel between the pair of parallel longitudinal support straps 30 such that the straps form a cross on the body support portion of the panel under a patient's upper body. Hip-to-shoulder straps 42 cross over underneath of the patient and assist in bearing the weight of the patient by dimensionally wrapping around the patient below the hips.

Preferably, the ends of the pair of hip-to-shoulder straps 42 are connected to the ends of mid-lateral strap 52 by buckles 60. These straps then support the patient's shoulders and hold the patient's arms in position over the litter, and secure and tighten the torso to the litter (as shown in FIG. 3).

Also preferably included is a hip strap 70 connected to the top side of panel 20. Hip strap 70 is dimensioned to wrap upwardly around a patient's hips, and lock together over the patient's hips using buckle 62. Strap 70 guards against the patient sliding out of the litter. Preferably, a center strap 72 is connected to hip strap 70. As can be seen in FIG. 3, the center strap 72 thus runs parallel to the pair of longitudinal support straps 30 over the center of a patient's upper body. The pair of hip-to-shoulder straps 42 each have a connecting ring 43, and the center strap 72 has carabiner 73 thereon. Carabiner 73 then attaches onto the connecting rings 43 on both of the hip-to-shoulder straps 42, thereby securing the patient in position. It is to be understood that the present invention is not limited to these specific strap pattern/design. Rather, the present invention also encompasses different embodiments of interlocking patient stabilization straps 40 that hold the patient in position, including versions with more or less straps, and different connector mechanisms.

Preferably also included is a drag handle 80 spanning between the pair of parallel support straps 30 adjacent to the head support portion 26 of panel 20. As will be explained, this drag handle can be used when a single rescuer is dragging a patient on the litter across the ground. Drag handle 80 can also be used to unfurl the litter. For example, the user simply grasps onto drag handle 80 and tosses out the litter out onto the ground. The litter then rolls out to its full length and is immediately ready for use.

Preferably as well, body support portion 24 of panel 20 has side extension portions 25 that are dimensioned to be wrapped up around the sides of the patient and be held in position by hip strap 70. As can be seen, side extension portions 25 are preferably widest near the body support portion 24 and progressively narrow towards the leg support portion 22. When in use, the wide side extension portions 25 can be wrapped up over the sides of the patient, assisting in keeping the patient's arms inside the litter.

In optional embodiments, litter 10 may also comprise a first pair of loop straps 90 connected to the longitudinal support straps 30 at a position adjacent to the body and head support portions 24 and 26 of panel 20; and a second pair of loop straps 92 connected to the longitudinal support straps 30 at a position adjacent to the leg support portion 22 of panel 24. Loop straps 90 and 92 can be used for alternate carrying strategies (including hands-free carrying), with buckles 66 connected to loop straps 90 and buckles 68 connected to loop straps 92, as will be explained below.

Referring next to FIGS. 5 to 11, an exemplary method of assembling the present invention will be shown. In this method, all of the various straps are preferably sewn onto panel 20 to reinforce the strength of the litter. Most preferably, each strap is sewn to the canvas separately (rather than simply being stacked and then stitched together) to increase the strength of the litter.

Figure 5:
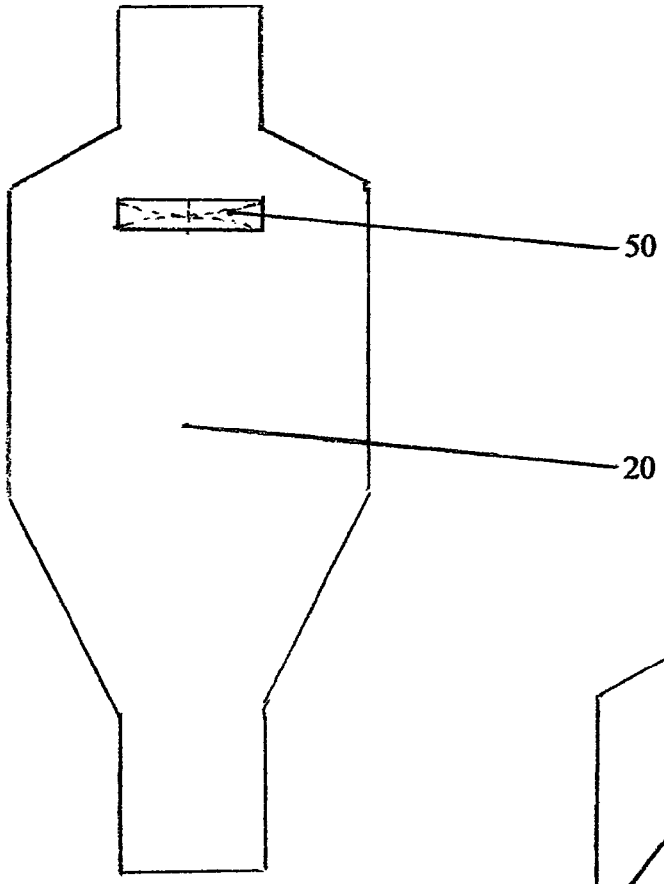
FIGS. 5 through 11 are sequential steps in the assembling of the present invention.
Figure 6:
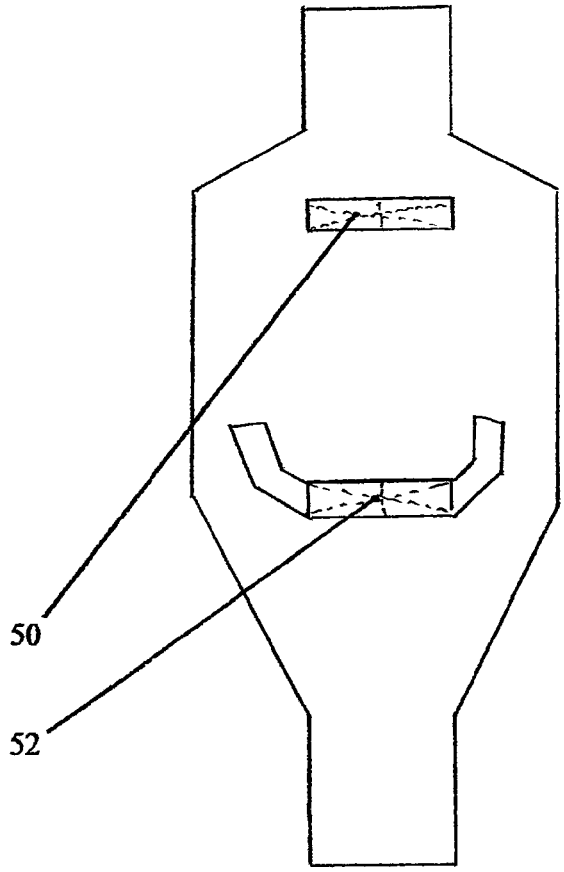
Figure 7:
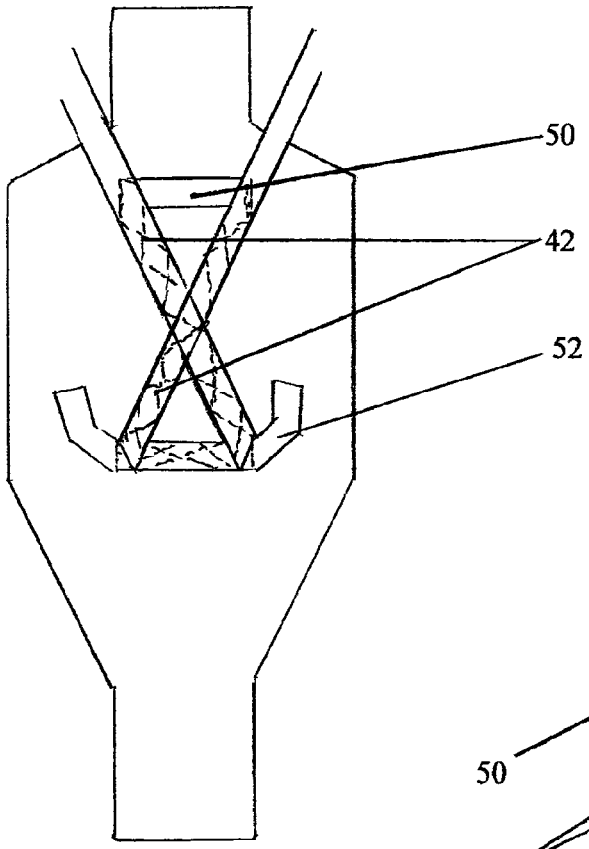
Figure 8:
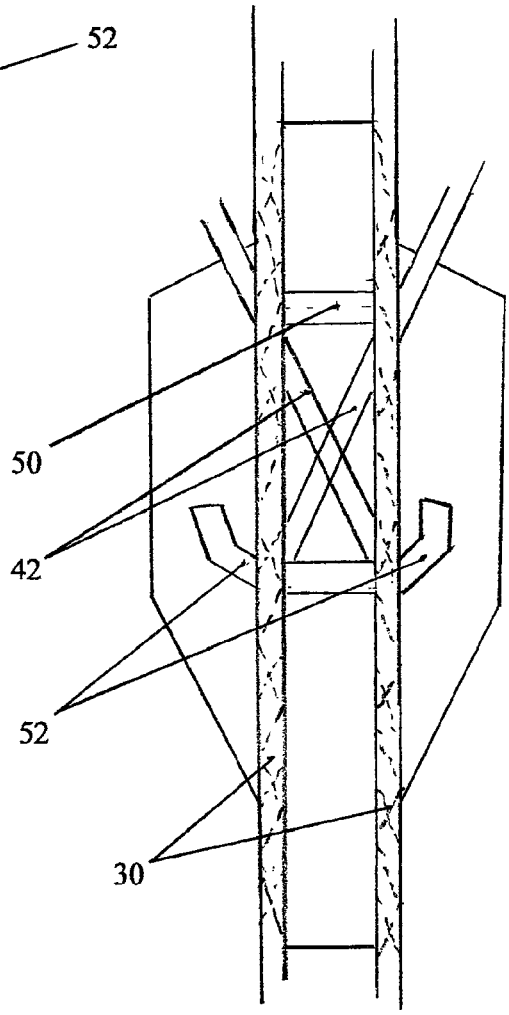

First, as seen in FIG. 5, upper lateral strap 50 is sewn onto canvas panel 20. Next, as seen in FIG. 6, mid-lateral strap 52 is sewn onto canvas panel 20. Next, as seen in FIG. 7, hip-to-shoulder straps 42 are sewn onto canvas panel 20 forming a cross on the body support portion 24 of panel 20. At this time, the two connecting rings 43 may be slid onto the free ends of hip-to-shoulder straps 42. Next, as seen in FIG. 8, a pair of longitudinal support straps 30 are sewn onto panel 20. At this time, buckle connectors 66 and 68 may be attached onto the opposite ends of longitudinal support straps 30. As can be seen, longitudinal support straps 30 pass over (and are sewn onto) straps 50, 52 and 42, further reinforcing the load-bearing capacity of the litter.

Figure 9:
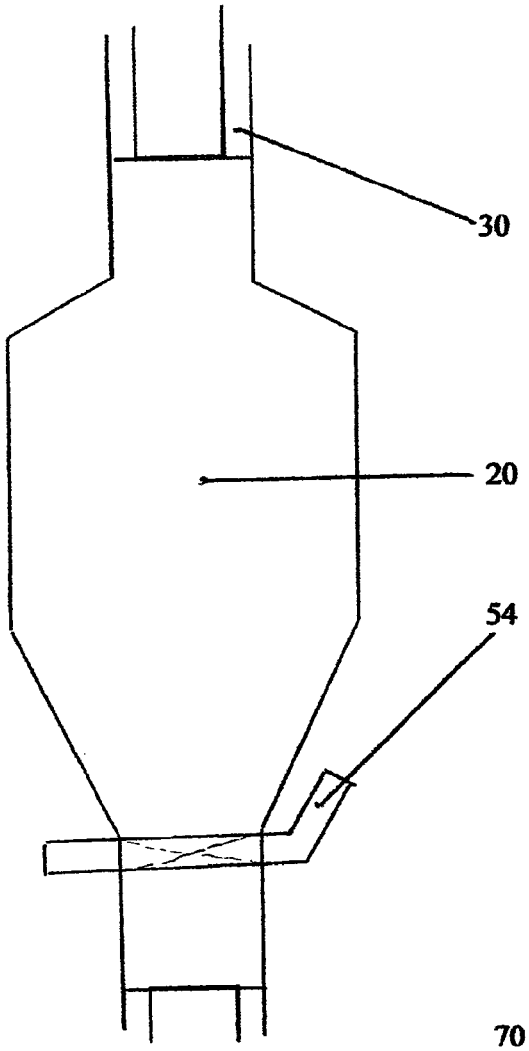
Figure 10:
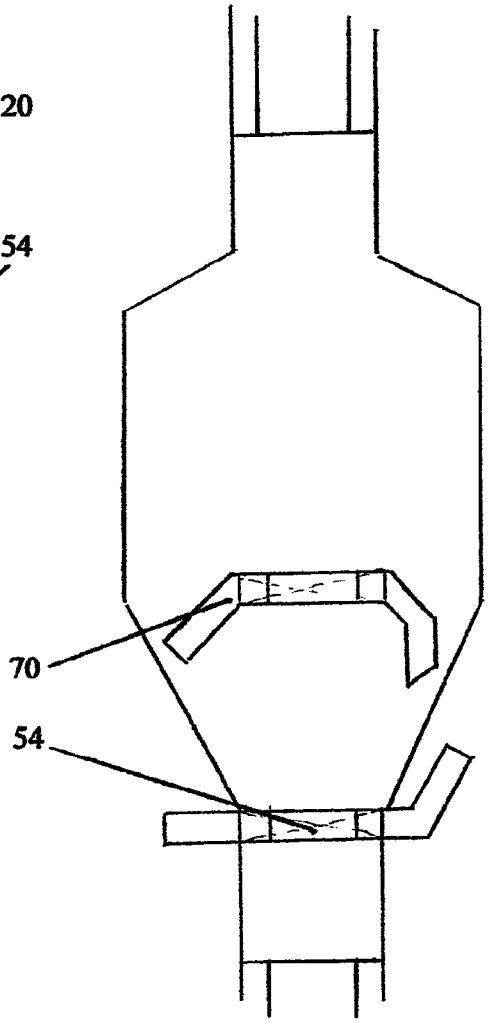
Figure 11:
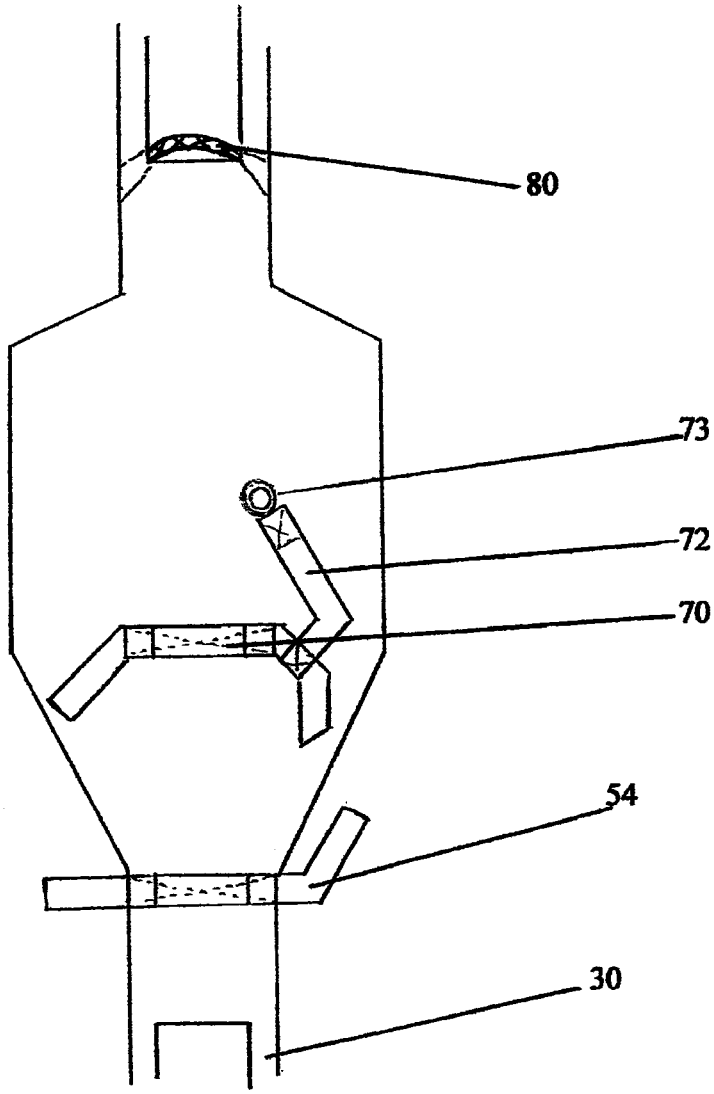

Next, as seen in FIG. 9, panel 20 is flipped right side up and shin strap 54 is sewn onto canvas panel 20. Next, as seen in FIG. 10, hip strap 70 is sewn onto the top of the litter. Next, as seen in FIG. 11, center strap 72 is fastened onto hip strap 70. Preferably, center strap 72 has a looped bottom end that is simply slipped over hip strap 70 such that center strap 72 is free to slide along hip strap 70. This permits center strap 72 to be positioned above the body centerline of the patient regardless of the patient's size and circumference. In addition, a drag handle 80 may be attached (spanning between longitudinal support straps 30 at a position above a patient's head) as shown.

Once the patient has been rolled or placed onto the litter, (s)he may be dragged to a safer area. At that time, the rescuer(s) can determine what transport method to use and quickly adjust the strapping on the litter for that particular mode of transport. FIGS. 12 to 20 illustrate the excellent flexibility of the present invention by showing various ways in which the litter can be used by one or more rescuers to transport a patient.

Figure 12:
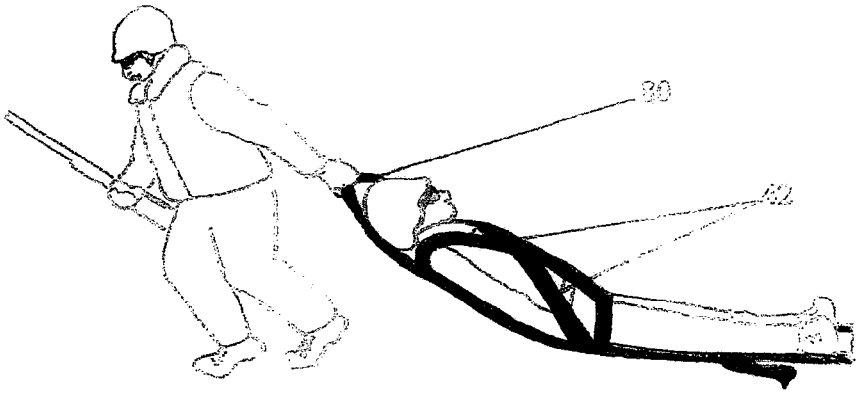
FIGS. 12 through 20 illustrate different methods of transporting a patient using the present invention.

Referring first to FIG. 12, litter 10 can be used by a single rescuer to quickly drag a patient out of a dangerous area by holding onto drag handle 80, and pulling the patient along the ground. This also has the benefit of raising the patient's torso off the ground, thereby reducing friction, making a more rapid drag speed possible. Advantageously, panel 10 protects the patient from ground debris and supports the patient's head, putting less stress on the patient's neck.

Figure 13:
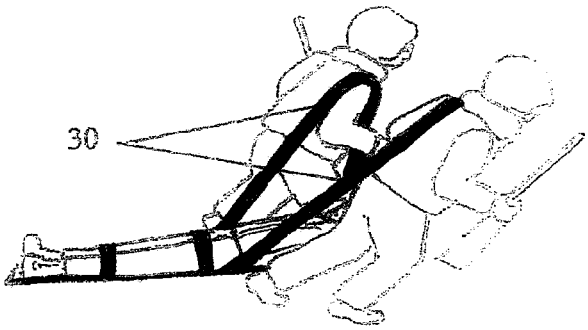

Referring next to FIG. 13, a hasty two-person rescue is illustrated. The patient is secured to litter 10 by hip strap 70 being secured about four to six inches below the bend in the hip. This prevents the patient from sliding down. Next, each of the two rescuers then place one of their arms through the loop of hip-to-shoulder straps 42. Both of the rescuers will then be able to move very quickly, keeping the patient at a 25 to 30 degree incline to the ground, while dragging the patient to safety. A further advantage of this technique is that the two rescuers need not be of the same height as the size of the loop in hip-to-shoulder straps 42 is separately adjustable for each rescuer. In addition, the rescuers hands remain free to hold other objects.

Figure 14:
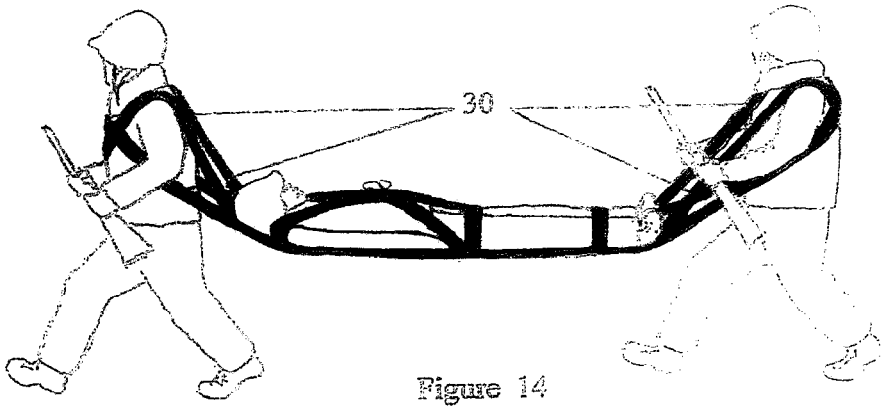

Referring next to FIG. 14, a two-person carry (for sustained over ground transport) is illustrated. With this method, the patient is first fastened to litter 10 by straps 42, 60, 70, 72 and 54. Carabiner 73 on center strap 70 is then fastened onto O-rings 43 (placing the patient in the position as shown in FIG. 3). A rescuer at each of the front and back ends then carries the patient using parallel longitudinal support straps 30 looped over their shoulders, and fastened back onto loop straps 90 using buckles 66, and loop straps 92 using straps 68. Both rescuers hands remain free during this carry.

Figure 15:
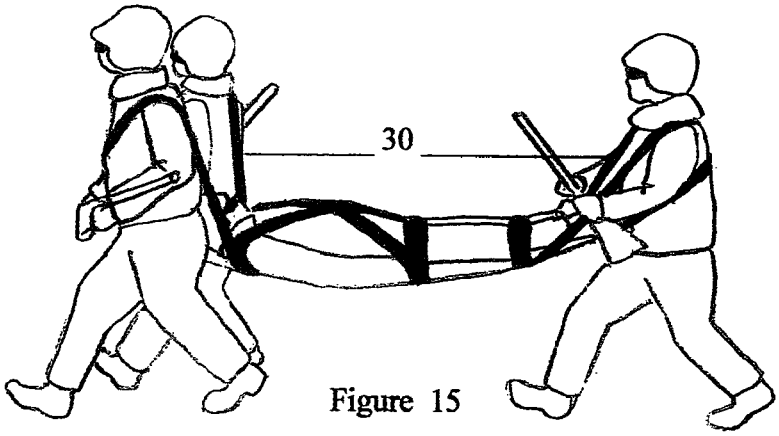

Referring next to FIG. 15, a three person carry (for sustained over ground transport) is illustrated. This method is very similar to that shown in FIG. 14; however, each front rescuer wraps only a single longitudinal support strap 30 around their shoulders, whereas the rescuer at the back wraps both longitudinal support straps 30 around his/her shoulders. Once all the straps are adjusted, this three person carry will allow for greater dispersion of the patient's weight and allow the three rescuers to travel even greater distances than the two-person carry. All three rescuers hands remain free during this carry.

Figure 16:
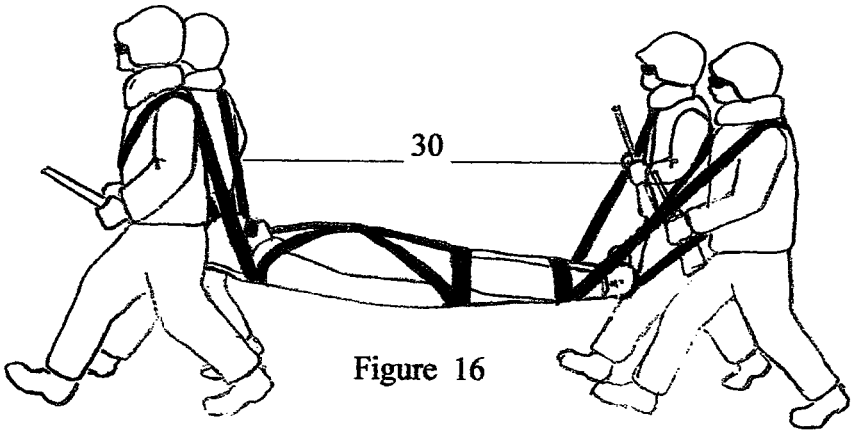

Referring next to FIG. 16, a four person carry is illustrated. In this method, the patient is secured to litter 10 in the same manner as in FIG. 15. However, each front and back rescuer only wraps a single longitudinal support strap 30 around their shoulders. Once all the straps are adjusted, this four person carry will allow for greater dispersion of the patient's weight and allow the four rescuers to travel even greater distances than the three-person or two-person carry. Moreover, the rescuers can switch out their positions quickly. For example, the rescuers on the left side can switch positions with the rescuers on the right side so as not to tire out only their left or right sides. All four rescuers hands remain free during this carry.

Figure 17:
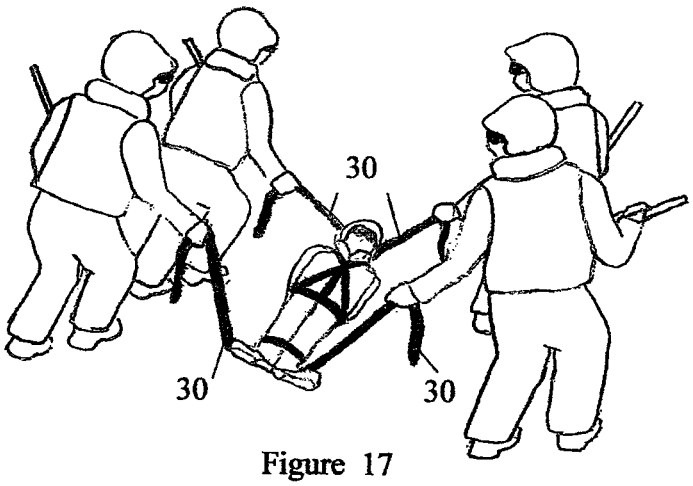

Referring next to FIG. 17, a hasty four person carry is illustrated. This carry can be used in situations when time does not permit fully securing the patient in the litter. In this method, the patient is simply secured to litter 10 by hip strap 70. The four rescuers position themselves around the litter, two in front and two in rear. Each rescuer grabs onto an end of longitudinal support straps 30 (and should wrap their hands around the strap for better control and better grip). In this method, the patient is simply carried "hammock-style". This method can even be effective for long distances since the rescuers can either switch out very quickly, or rotate around the patient.

Figure 18:
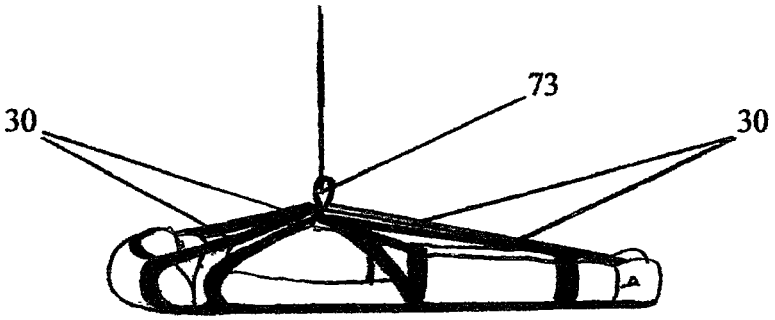

Referring next to FIG. 18, a method suitable for helicopter transport is shown. Specifically, litter 10 can be picked up by a rescue helicopter by attaching the helicopter's rescue cable directly to carabiner 73. In addition, the top and bottom ends of longitudinal support straps 30 are each connected back to the junction of O-rings 43 and carabiner 73. This prevents the patient's head or legs from dangling downwards. As a result, the litter is designed to lift from the shoulders and just below the hips. Since O-rings 43 are free-floating along hip-to-shoulder straps 42, O-rings 43 can be moved to a preferred position to best balance the particular patient's center of gravity. Moreover, an optional helo-lift strap may also be used in conjunction with this method during a helicopter evacuation.

Figure 19:
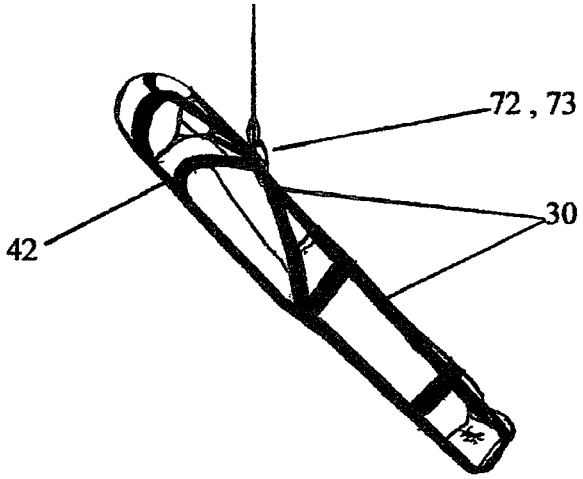

Referring next to FIG. 19, a method of lowering a patient from an elevated position is shown. This method is similar to that of FIG. 20; however, O-rings 43 are positioned higher up the sternum (than in FIG. 21), causing the patient to be rotated upwardly as shown. This method can be useful when lowering a patient down a cliff or rock face.

Figure 20:
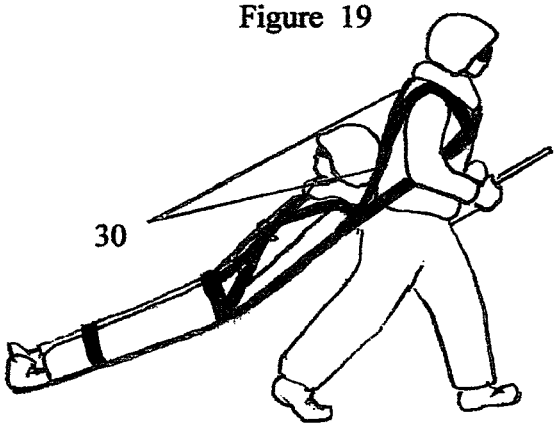

Referring next to FIG. 20, a one-person sustained drag is illustrated. In this method, the patient is secured to the litter in the same manner as in the two-person carry (of FIG. 14). However, the bottom ends of longitudinal support straps 30 will instead be connected back to the junction of O-rings 43 and carabiner 73, thus partially supporting the patient's legs, and preventing the legs from dangling. The top ends of longitudinal support straps 30 will be secured around the shoulders of the rescuer using the same configuration as was shown for the front rescuer in FIG. 14. The one-person drag of FIG. 20 is a slow method and generally a last resort. However, it can be used to transport a patient to safety while advantageously keeping the rescuer's hands free.

The present inventors have successfully built and tested the present invention. In device built by the inventors, the present canvas and straps litter can be used to hold tight to persons of any size although the litter itself only had a weight of around 6 lbs. When folded for use, it was only 15" wide, 8" long and 5" high. In contrast, when rolled out for use, it's patient support panel was 6'3½" in length and 3' in width at its widest point. It was constructed of readily available sturdy canvas material and safety strapping as commonly used in auto, boat and aircraft with a 4000 lb rating. The embodiment built by the present inventors comprises an awning-grade canvas panel, four hooks, nine buckles, two steel thread lock carabiners (with one being used as a safety precaution) and three O-rings.

In optional embodiments of the present invention, litter 10 may further comprising reflectors on its top and/or bottom. Moreover, the reflectors on the top may be of a first color, whereas the reflectors on the bottom may be a second color. This would help to rapidly distinguish between top and bottom of the litter in the dark. Alternatively, reflectors may only be placed only on one side (again, so as to rapidly distinguish between top and bottom of the litter in the dark).

In other optional embodiments, the various straps can be color coded to quickly match and be connected together. For example, the ends of a first pair of straps that are connected together may be of a first color, whereas the ends of another pair of straps that are connected together may be of a second color. Such a color scheme would allow a rescuer to rapidly assemble the litter.

All of the embodiments disclosed herein may include versions any or all straps being quick release straps.

Figure 21A:
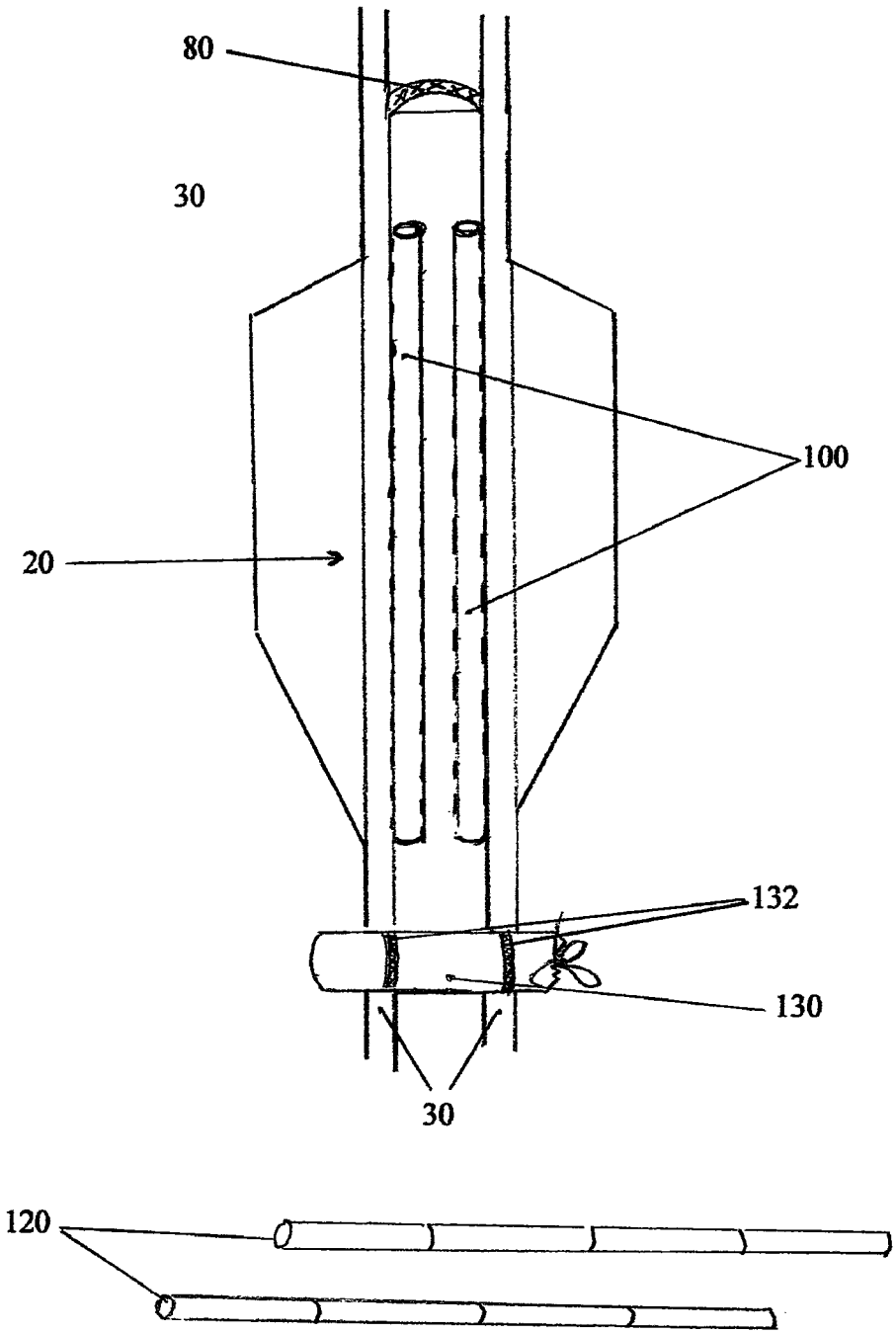
FIG. 21A illustrates an embodiment of the invention having center supports.

Other optional embodiments are illustrated in FIGS. 21A to 28, as follows:

FIG. 21A illustrates an embodiment of the invention in which a pair of pole sleeves 100 extend down the bottom side of litter 10. Poles 120 can be inserted into sleeves 100 to act as "center supports", giving litter 10 extra firmness, rigidity and stability for patient needs (and make it easier for two people to carry). Most preferably, optional poles 120 can be telescoping (or have detachable sections) such that they can be quickly shortened (or disassembled) and stored in bag 130. Storage bag 130 can be held in position by Velcro straps 132.

Figure 21B:
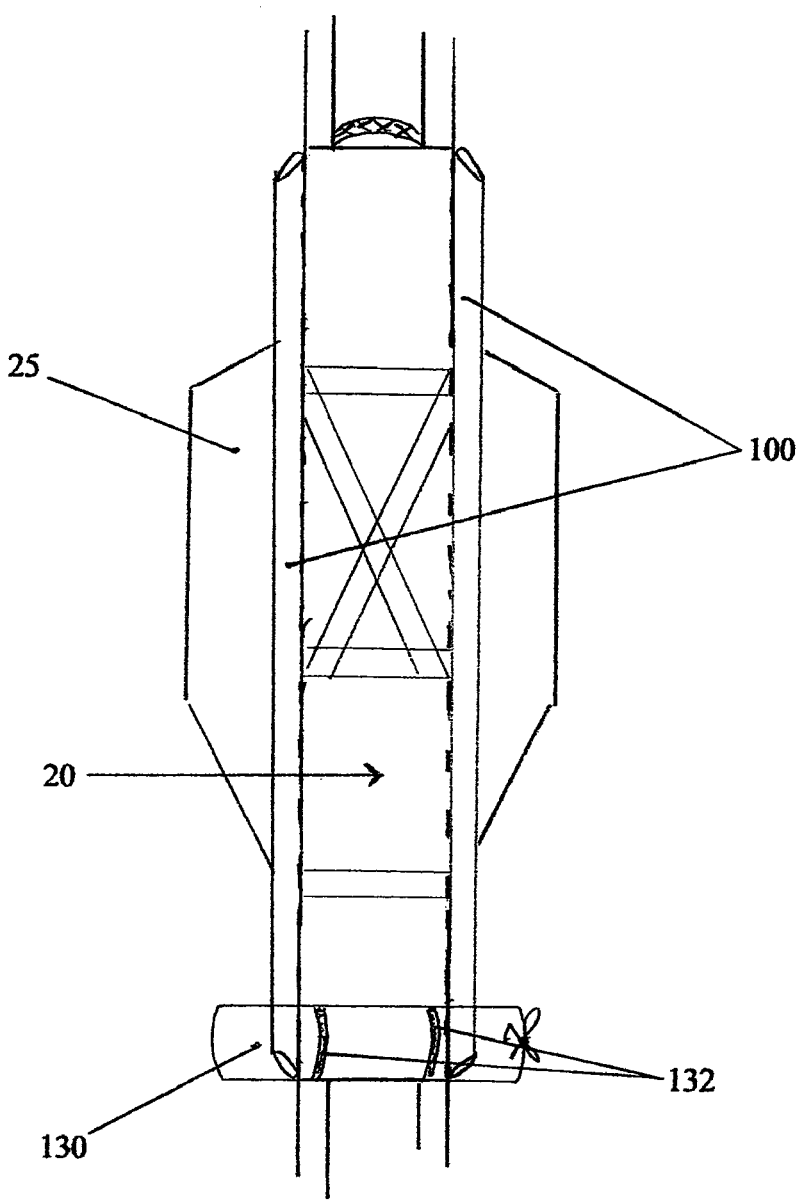
FIG. 21B illustrates an embodiment of the invention having optional side poles that span the full length of the patient's body to provide full length body support.

FIG. 21B illustrates an embodiment similar to FIG. 21A, however, sleeves 100 are longer and are positioned outside of parallel longitudinal straps 30. These sleeves are long enough to accommodate traditional litter poles. Most preferably, the optional poles can be telescoping (or have detachable sections) such that they can be quickly shortened (or disassembled) and stored in bag 130. Thus, they provide full body support (i.e.: longitudinal reinforcement that fully supports the patient's head and legs as well). Storage bag 130 can be held in position by Velcro straps 132.

Figure 22:
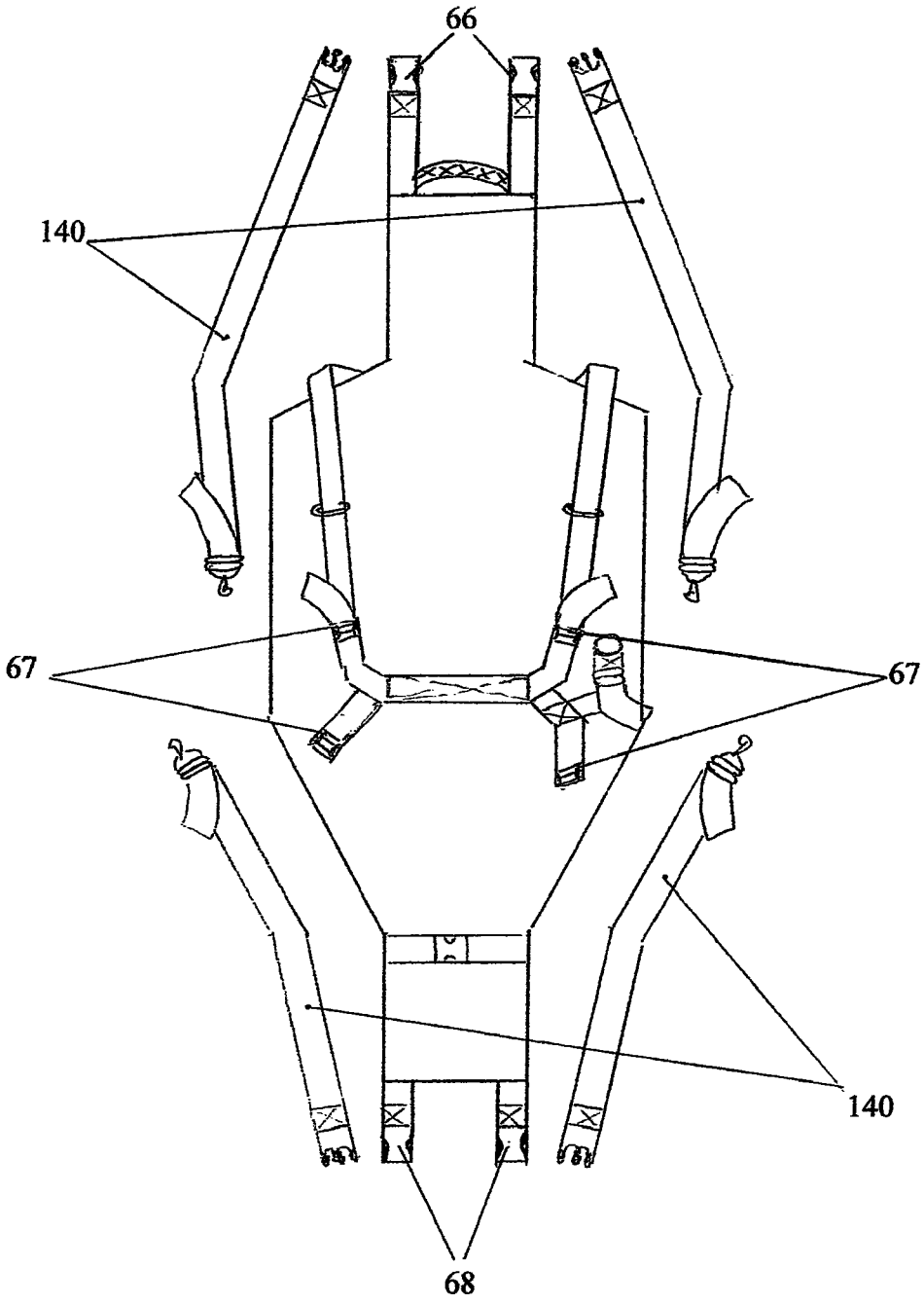
FIG. 22 illustrates an embodiment of the invention having plastic buckles and quick release options on the pair of longitudinally extending straps.

FIG. 22 shows yet another optional embodiment having buckles and a quick release option on longitudinal straps 30, as follows. Specifically, four quick release straps 140 are provided. Quick release straps 140 buckle onto buckle connectors 66 and 68, and onto buckles 67 (positioned the ends of straps 60 and 70).

Figure 23:
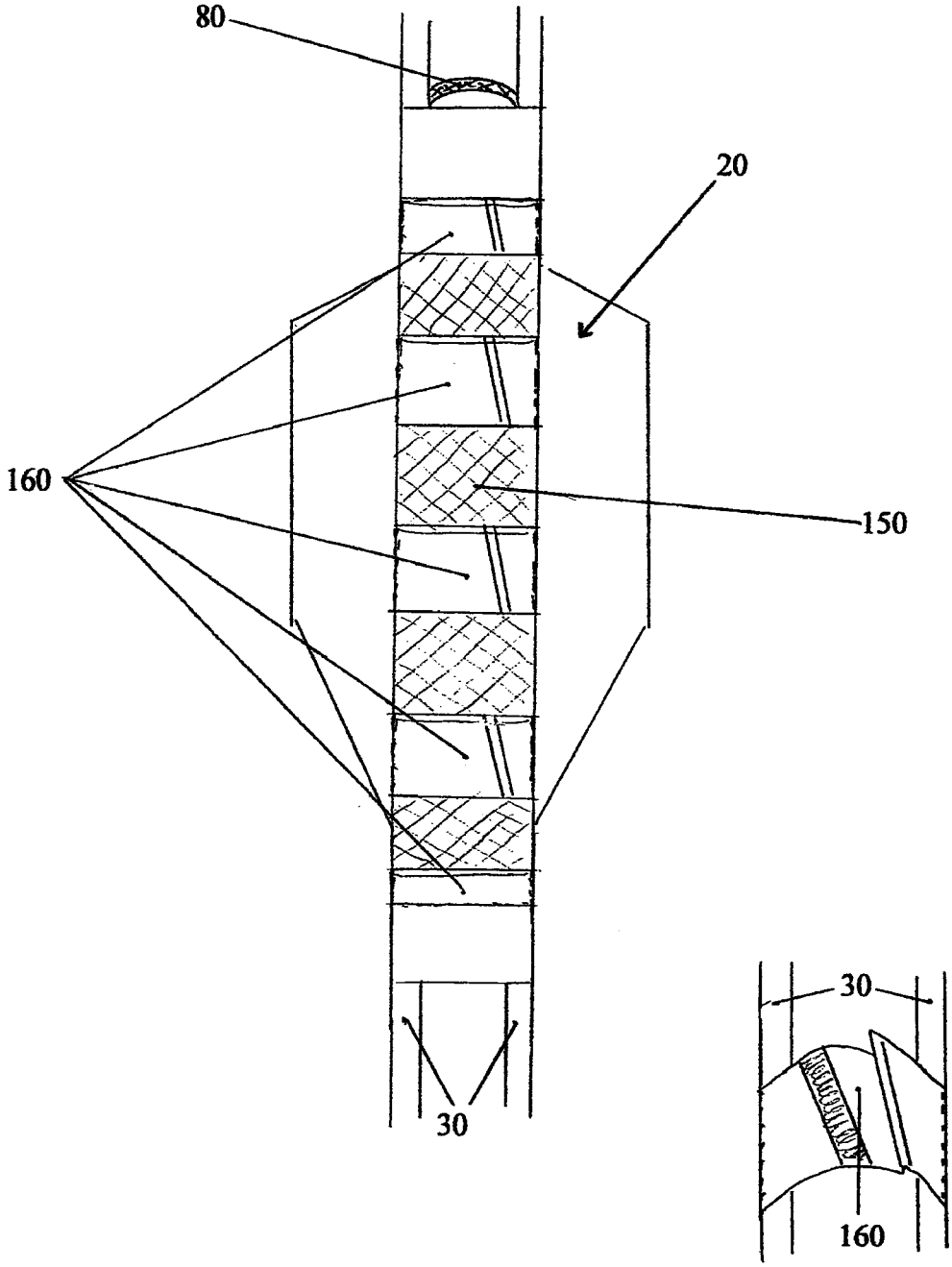
FIG. 23 illustrates an embodiment of the invention having a sleeve dimensioned to receive a flat support positioned under a patient.

FIG. 23 shows yet another optional embodiment in which litter 10 further comprises a flat support 150 positioned under a patient. Support 150 is held in position under panel 20 by being wrapped around by sleeves 160. Flat support 150 can be a thin hardened piece of plastic that assists in stabilizing under the patient. Sleeves 160 can be made of Velcro®.

Figure 24:
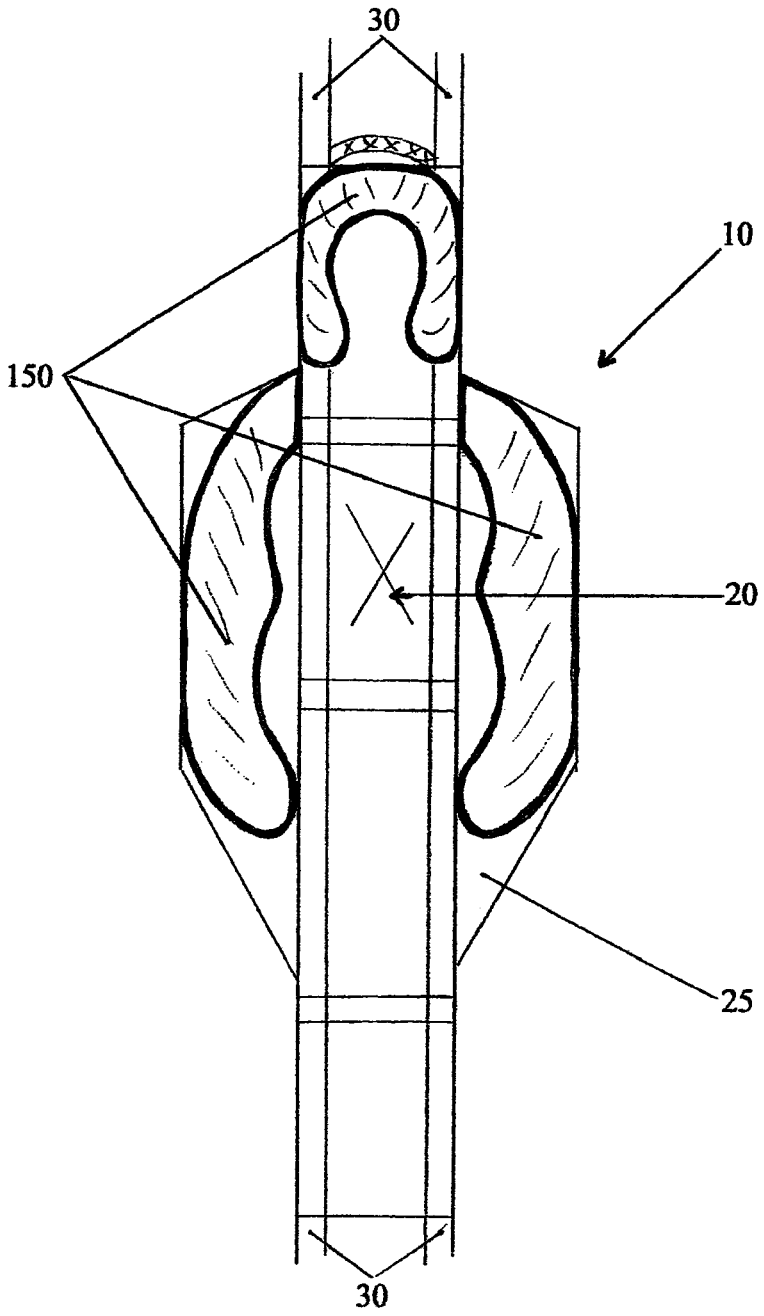
FIG. 24 illustrates an embodiment of the invention having optional gas filled bladders to provide flotation of the litter.

FIG. 24 shows an embodiment with optional gas filled bladders 150 positioned near the sides and head of the patient on litter 10. This embodiment provides flotation of the litter during water transport.

Figure 25:
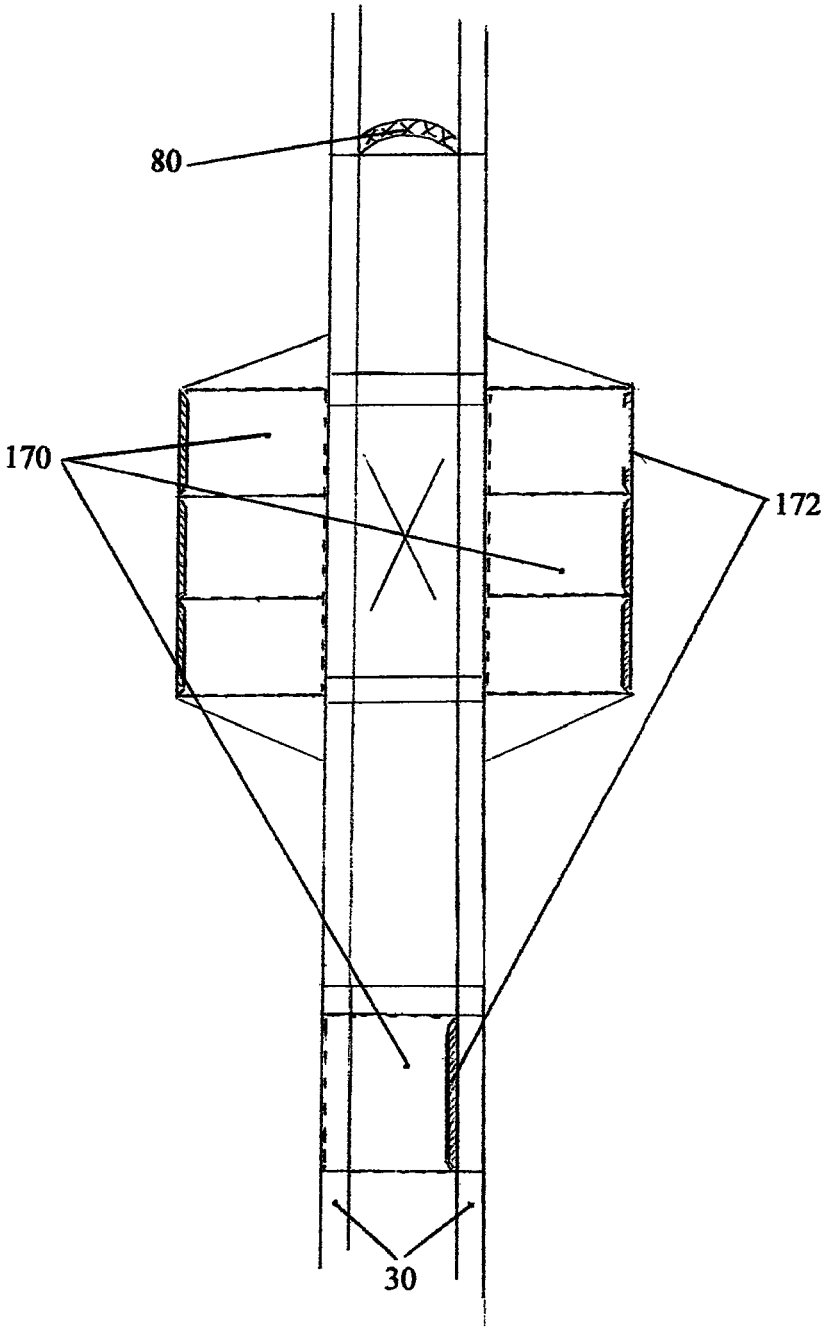
FIG. 25 illustrates an embodiment of the invention having optional storage pockets.

FIG. 25 shows another optional embodiment in which panel 20 comprises one or more storage pockets 170 in which to place medical supplies. Pockets 170 are closed by Velcro® closures 172.

Figure 26:
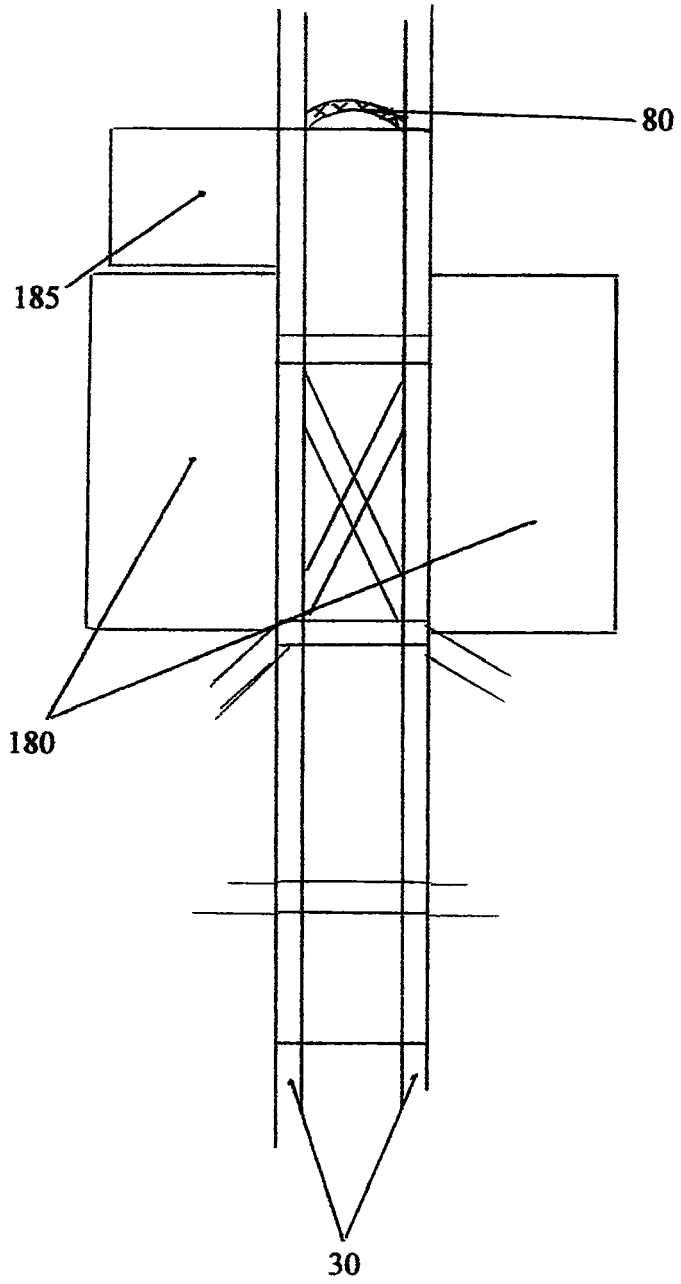
FIG. 26 illustrates an embodiment of the invention having fabric closures that can be unfolded and wrapped around the patient to protect the patient against inclement weather, and/or difficult terrain.

FIG. 26 shows another optional embodiment in which litter 10 further includes fabric closures 180 and 185 that can be unfolded and wrapped around the front of the patient to protect the patient against inclement weather. Preferably fabric closures 180 and 185 are simply stored folded up on the back of the litter when not in use. (Closures 180 protect the body and closure 185 will protect the face).

Figure 27:
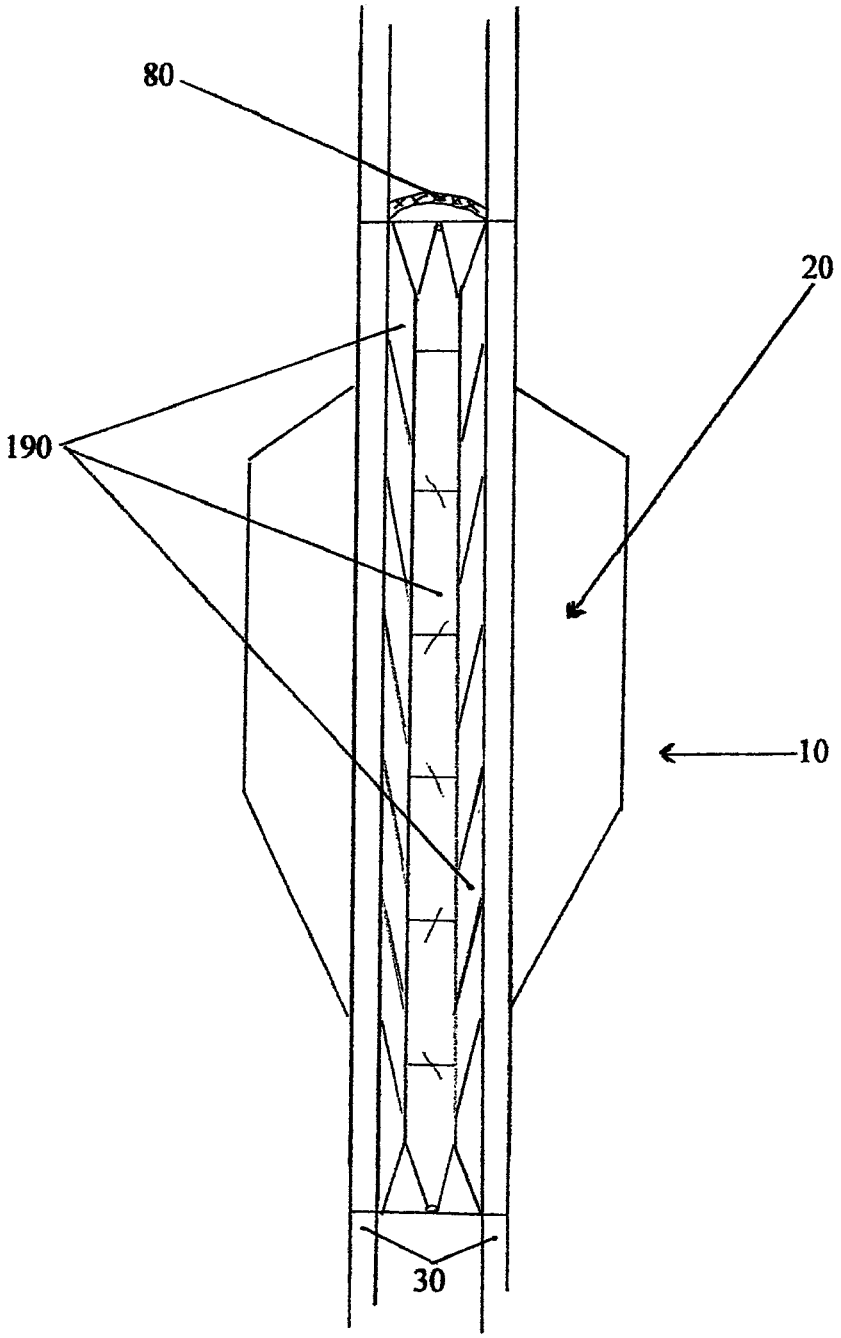
FIG. 27 illustrates an embodiment of the invention having a plurality of sections for receiving quick hardening foams therein.

FIG. 27 shows another optional embodiment in which litter 10 further includes a plurality of sections 190 for injecting quick hardening foams therein. Injecting the foam into these sections 190 causes the litter 10 to be both rigid and to float.

FIGS. 28A to 28C shows another optional embodiment having a folding framework for torso and head support, as follows. In FIG. 28A, a pair of T-shaped supports 200A and 200B are shown. These T-shaped supports 200A and 200B each comprise two pieces that pivot around a common point 201. Both T-shaped supports 200A and 200B may initially be rotated such that their lower portions are fully underneath their top portions. Then as shown in FIG. 28A, T-shaped supports 200A and 200B can then be rotated to the positions shown (With 200A being a "T" and 200B being an "X"). Next, members 220 and 230 can then be attached (as shown in FIG. 28B). This attachment can be made by slipping support 200A onto one end of member 220, and slipping member 200B onto the opposite end of member 220. Similarly, support 200B can be slipped onto the end of member 230. Preferably, member 220 may have one or more attachment points for either or both of supports 200A and 200B at its opposite ends. As a result, the distance between supports 200A and 200B can be adjusted to be closer together or farther apart. Finally, as seen in FIG. 28C, the torso and head support assembly formed by supports 200A and 200B and members 220 and 230 can be placed onto litter 10, thereby providing support to the patient's torso and head.

Figure 29:
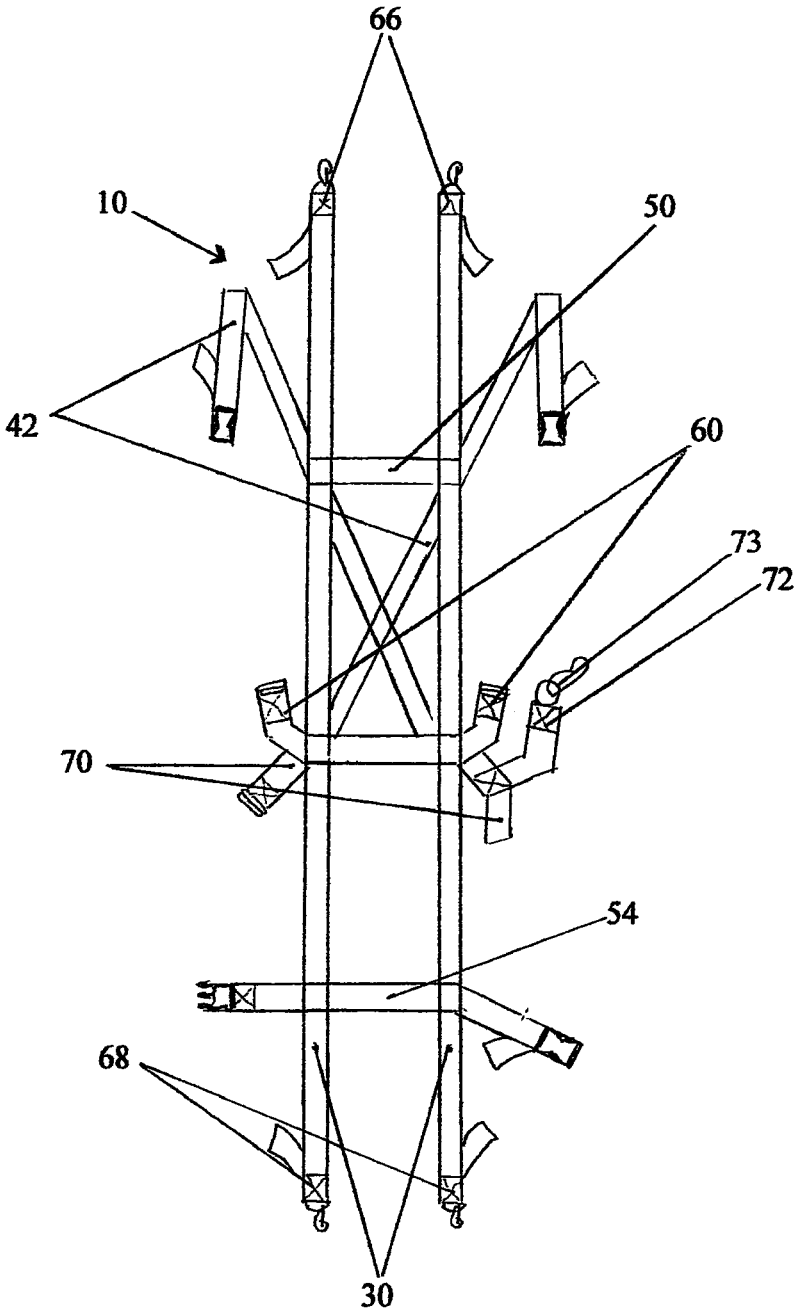
FIG. 29 is an embodiment of the invention that lacks a support panel, and relies upon straps alone.

FIG. 29 is an embodiment of the invention that lacks a support panel, and relies upon straps alone to support the patient.

What is claimed is:

1. A litter, comprising:

a panel having a leg support portion, a body support portion and a head support portion;

a pair of parallel longitudinal support straps running along the length of the panel, and extending from opposite ends of the panel; and a plurality of interlocking hip-to-shoulder patient stabilization straps crossing diagonally underneath the panel under the patient's upper body, and extending out from underneath the bottom of the body support portion of the panel up around the edges of the panel and over the top of the panel to cross diagonally over a patient's upper body and lock together over the chest of the patient's upper body;

a mid-lateral strap extending out from underneath the bottom of the body support portion of the panel up around the edges of the panel to connect to ends of the hip-to-shoulder patient stabilization straps;

a hip strap connected to the top of the body support portion of the panel to wrap around a patient's hips, and lock together over a patient's hips; and a center strap connected to the hip strap, wherein an end of the center strap locks together with the hip-to-shoulder patient stabilization straps at an intersection point over the chest of the patient's upper body.

2. The littler of claim 1, wherein the panel is a fabric panel.

3. The litter of claim 2, wherein the fabric panel is canvas.

4. The litter of claim 1, wherein the pair of parallel longitudinal support straps are sewn onto the leg, body and head support portions of the panel.

5. The litter of claim 1, further comprising:

an upper lateral strap connected to the pair of longitudinal support straps, wherein the upper lateral strap extends perpendicularly between the pair of longitudinal support straps across the panel in an area adjacent to a patient's neck and shoulders.

6. The litter of claim 1, wherein the litter can be carried by a rescuer around the rescuer's shoulder with the rescuer's hands remaining free.

7. The litter of claim 1, further comprising:

a shin strap connected to the panel, the shin strap extending perpendicular to the pair of longitudinal support straps, the shin strap being dimensioned to wrap around a patients shins, and lock together over the front of the patient's shins.

8. The litter of claim 1, further comprising a plurality of sections for receiving quick hardening foams therein.

9. The litter of claim 1, further comprising:

fabric closures that can be unfolded and wrapped around the front of the patient to protect the patient against inclement weather.

10. The litter of claim 1, further comprising:

one or more storage pockets in which to place medical supplies.

11. The litter of claim 1, further comprising:

a pair of pole sleeves running along opposite lateral sides of the litter; and a pair of poles received within the pair of pole sleeves.

12. The litter of claim 1, further comprising:

a flat support positioned under a patient; and a sleeve dimensioned to wrap around the flat support.

13. The litter of claim 1, wherein the pair of hip-to-shoulder straps each have a connecting ring, and wherein the center strap has a carabiner thereon, and wherein the carabiner attaches to the connecting rings on the hip-to-shoulder straps.

14. The litter of claim 1, further comprising:

a drag handle spanning between the pair of parallel support straps adjacent to the head support portion of the panel.

15. The litter of claim 1, wherein the body support portion of the panel has side extension portions that are dimensioned to be wrapped up around the sides of a patient and be held in position by the hip strap.

16. The litter of claim 15, wherein the side extension portions narrow towards the leg support portion.

17. The litter of claim 1, further comprising:

a first pair of loop straps connected to the longitudinal support straps at a position adjacent to the body and head support portions of the panel; and a second pair of loop straps connected to the longitudinal support straps at a position adjacent to the leg support portion of the panel.

18. The litter of claim 1, further comprising: a gas filled bladder connected to the panel for providing flotation of the litter.

19. The litter of claim 1. further comprising: a reflector of a first color on the top of the panel; and a reflector of a second color on the bottom of the panel.

* * * * *